United States Patent [19]

Hall et al.

[11] 3,967,542

[45] July 6, 1976

[54] HYDRAULIC INTENSIFIER

[75] Inventors: Richard W. Hall; Daniel A. Schutte; Sven Sonnenberg, all of Springfield, Ohio

[73] Assignee: Kelsey-Hayes Company, Springfield, Ohio

[22] Filed: Nov. 20, 1974

[21] Appl. No.: 525,568

[52] U.S. Cl. ..... 92/85 B; 92/128; 417/454; 417/900

[51] Int. Cl.[2] ..... F01B 11/02

[58] Field of Search ..... 417/342, 454, 539, 900; 92/165 R, 85, 128; 285/363

[56] References Cited

UNITED STATES PATENTS

| | | | |
|---|---|---|---|
| 1,469,267 | 10/1923 | Rembold | 92/128 |
| 2,325,672 | 8/1943 | Groff | 417/454 |
| 2,733,664 | 2/1956 | Saalfrank | 417/454 |
| 3,267,815 | 8/1966 | Ortman et al. | 92/85 |
| 3,425,718 | 2/1969 | Shaw | 285/173 |
| 3,592,106 | 7/1971 | Baughman | 92/85 |
| 3,650,638 | 3/1972 | Cole | 417/900 |
| 3,847,404 | 11/1974 | Agostino | 92/165 R |

*Primary Examiner*—William L. Freeh
*Assistant Examiner*—G. P. LaPointe
*Attorney, Agent, or Firm*—Biebel, French & Nauman

[57] ABSTRACT

A hydraulic intensifier for oil well fracturing and/or erosion drilling incorporates a pair of intensifier units mounted on a common bed. The intensifier units are particularly defined for ease of maintenance in the field, and structure is provided by which the ram seals as well as the ram, the ram cylinder, and the hydraulic cylinder can be easily and readily removed in the field without the necessity for releasing the tension on the tie rods. To this end, the apparatus includes a front wall which supports the ram cylinder and an intermediate wall which supports the forward end of the hydraulic cylinder. The space between these walls and the manner in which the components are assembled permits the ram seal assembly, the ram and ram cylinder, and hydraulic piston to be extracted and reinserted. Also, an improved ram return system and a hydraulic cushioning system are disclosed.

5 Claims, 10 Drawing Figures

COMP.
R.V.
TANK

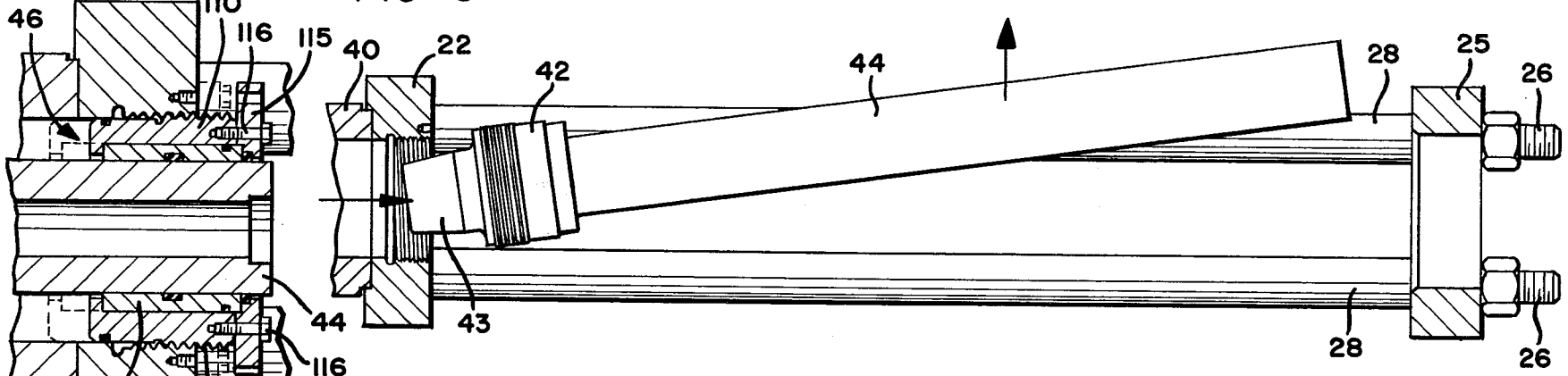
FIG-9
FIG-8
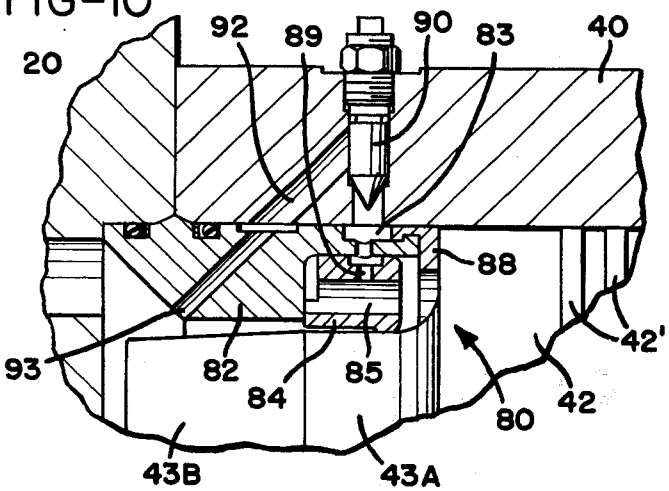
FIG-10

HYDRAULIC INTENSIFIER

BACKGROUND OF THE INVENTION

This invention relates to hydraulic intensifiers and well stimulation apparatus of the general type disclosed in U.S. Pat. No. 3,773,438 issued Nov. 20, 1973.

In the apparatus of the type disclosed, very high pressure fluid is applied for oil well servicing, such as for stimulating old or unused wells to make them productive. In this use, acid or a sand-containing fluid is pumped into the well under very high pressures, such as pressures up to 21000 PSI and above, at a continuous flow rate with no pulsations. Further, such extreme high pressure pumping apparatus is employed for jet drilling in which high pressure drilling mud is pumped by the intensifier through the drill string to the drill bit. The fluid passes at high velocity through the small openings in the drill bit to cut narrow slots or channels within the hole being drilled. The used fluid is then recycled for reuse.

The hydraulic intensifiers of the type shown in the above-identified U.S. patent are employed in the field at the well site under different conditions of use, and remote from service. It is important that these units operate with a minimum of lost time due to service problems. The service problems are particularly severe due to the corrosive or abrasive character of the fluid being pumped and due to the extreme high pressures which are being generated within the fluid.

SUMMARY OF THE INVENTION

The present invention is directed to hydraulic intensifier apparatus of the general type outlined above which is particularly adapted for ease of field maintenance and service. The working rams and ram cylinders as well as all the packings associated with the ram and cylinders may be readily removed in the field for service and/or repair. In fact, the working ram and its cylinder can be removed without the necessity for disturbing the remaining components including the hydraulic cylinder or its piston or the tension tie rods. Thus, the elements of the intensifier which are most subject to wear and which require the most frequent maintenance may be quickly removed and replaced or repaired and the intensifier unit placed back into service with a minimum of down-time. Further, the hydraulic piston itself may easily be removed so that its seals may be serviced, as required.

The primary object of ease of serviceability is obtained by the employment of an overall structure which includes front walls or plates within which the working ram cylinders are mounted. These front plates are tied to a back valve manifold by means of a plurality of tensioned tie bolts. The ram cylinders are captured within the front plates and terminate in valving apparatus including inlet and outlet valves through which the working fluid is handled. The seals are carried directly on the working cylinders inwardly of the front plates and are easily removable for service. The ram pistons do not carry any seals, and are also removable by extraction through clearance spaces which are defined between the front plates and a pair of intermediate plates. The forward ends of the hydraulic cylinders are supported on the intermediate plates. The axial clearance space provided between the front and intermediate plates as well as the transverse space between the tie bolts is such as to permit the extraction and insertion of the working rams therethrough. Similarly, with the working ram removed, the ram cylinder may be removed by withdrawal through the clearance space. In addition, if it is necessary to repair the seals on the hydraulic piston, it also may be extracted by movement forwardly into the clearance space defined between the front and intermediate walls.

In addition to being configured for ease of service, without the necessity of disturbing or loosening the tension rods, the invention also incorporates an improved hydraulic cushion mechanism which cooperates with the inner or rear end of the hydraulic cylinder. This mechanism hydraulically cushions the return movement of the pistons.

It is accordingly an important object of the invention to provide an extreme high pressure intensifier which is characterized by its ease of serviceability and maintainability in the field.

Another important object of the invention is the provision of a hydraulic intensifier of simplified construction.

A still further object of the invention is the provision of a hydraulic intensifier incorporating a return oil cushion mechanism.

These and other objects and advantages of the invention will be apparent from the following description, the accompanying drawings, and the appended claims.

BRIEF DESCRIPTION OF THE DRAWINGS

FIG. 8 is an enlarged section through the removable bearing support for the piston rod;

FIG. 9 is a view showing the manner in which the piston rod and attached piston may be removed within the clearance space between the front and intermediate walls; and, FIG. 10 is an enlarged partial sectional view through the hydraulic return cushion mechanism.

DESCRIPTION OF PREFERRED EMBODIMENT

Figure 1:
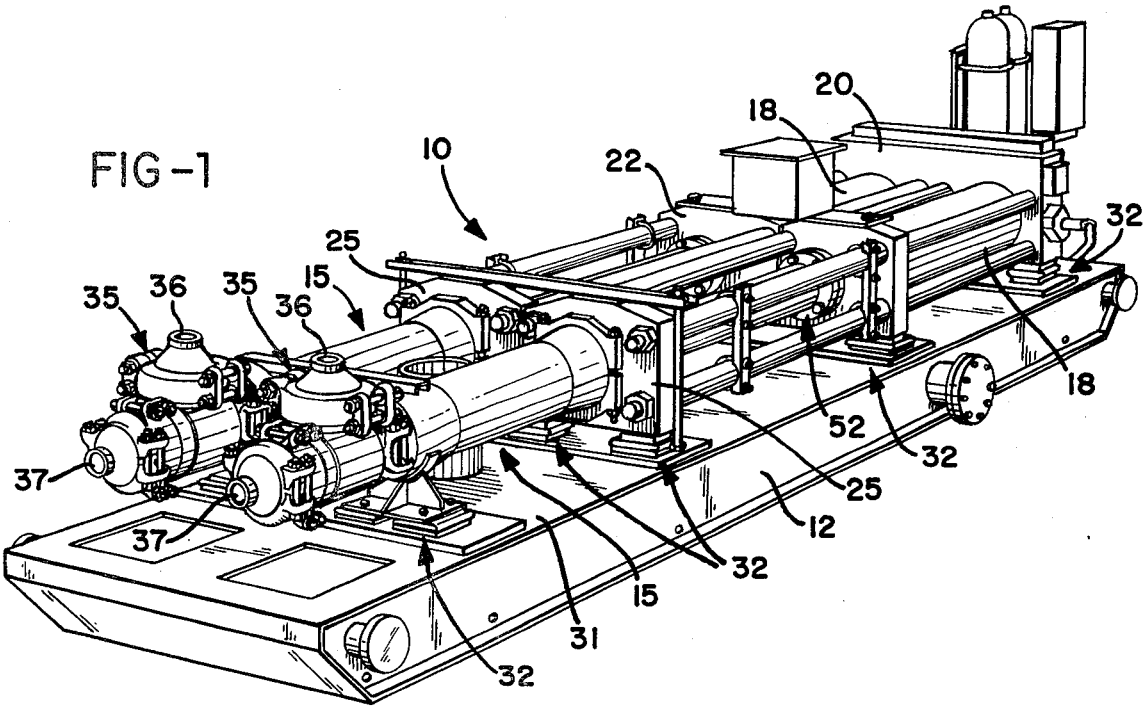
FIG. 1 is a perspective view of an intensifier according to this invention mounted on a skid.
Figure 2:
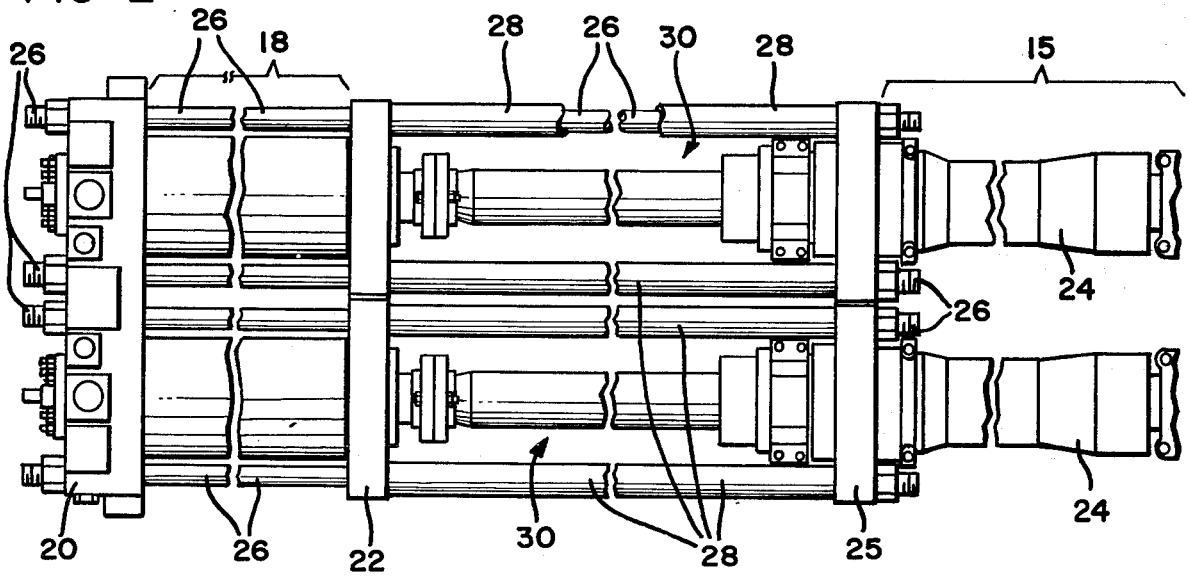
FIG. 2 is a plan view, partially broken away, of the intensifier of FIG. 1.

Referring to FIGS. 1 and 2 the intensifier apparatus constructed according to this invention is illustrated generally at 10 and is mounted on a base or skid 12. The skid-mounted intensifier apparatus is preferred where the unit is to be placed at a location in the field and used for an extensive period of time, such as for erosion drilling. However, the unit may be used equally for well fracturing, but in this instance, it may be preferred to mount the same on a semi-trailer or a truck.

A two-piston type of hydraulically operated intensifier is disclosed herein, and this intensifier may be controlled and operated in accordance with the teachings of U.S. Pat. No. 3,773,438. It thus preferably consists of a pair of intensifier ram portions 15 which are separately and sequentially operated by a pair of hydraulic piston motors 18. The description of the intensifier apparatus herein including the structural details hereof will generally be confined to one of the two identical intensifiers, since the description applies equally to either of these intensifier units.

The overall construction includes a rear support plate which also is a valve manifold block, and is illustrated generally at 20. The valve manifold block 20 incorporates removable manifold-type valving for applying hydraulic fluid under pressure to one of the piston motors 18. It also serves as a rear abutment plate for the associated hydraulic motor.

The forward ends of the piston motors are directly supported on intermediate walls 22 while the ram cylinders 24 are directly supported on individual front walls 25. Four tie rods 26 extend longitudinally between each front wall 25 and the associated manifold block 20 through openings in the intermediate wall 22, and are torqued or drawn to a total tension which exceeds the force applied thereto by the intensifier. The spacing of the intermediate wall with respect to the front wall is defined and maintained by spacer means in the form of tubular sleeves 28 assembled over the tie rods 26. The intermediate and front walls and the adjacent pair of upper tie rods define therebetween a clearance space shown generally at 30 in FIG. 2.

The manifold block 20, the intermediate wall 22, the front wall 25 and the forward end of the ram cylinders 24 are supported on the upper surface 31 of the skid 12 by means of individual elastomer blocks which are illustrated generally at 32. The blocks 32 provide for a certain amount of torsional movement as well as linear twisting movement within each of the intensifier assemblies when the same are operating under high stress condition, and also provide a shock mounting for the entire intensifier unit with respect to the skid 12.

The forward end of each of the working ram portions 15 is provided with a valve assembly indicated generally at 35, by means of which the ram portions 15 are connected to a source of working fluid and to the oil well. The assembly includes an inlet 36 and an outlet 37, and the entire assembly may be made according to the teachings of the U.S. Pat. of Love et al No. 3,801,234 issued Apr. 2, 1974, with particular reference to the embodiment shown in FIG. 4 of that patent.

Figures 3, 4:
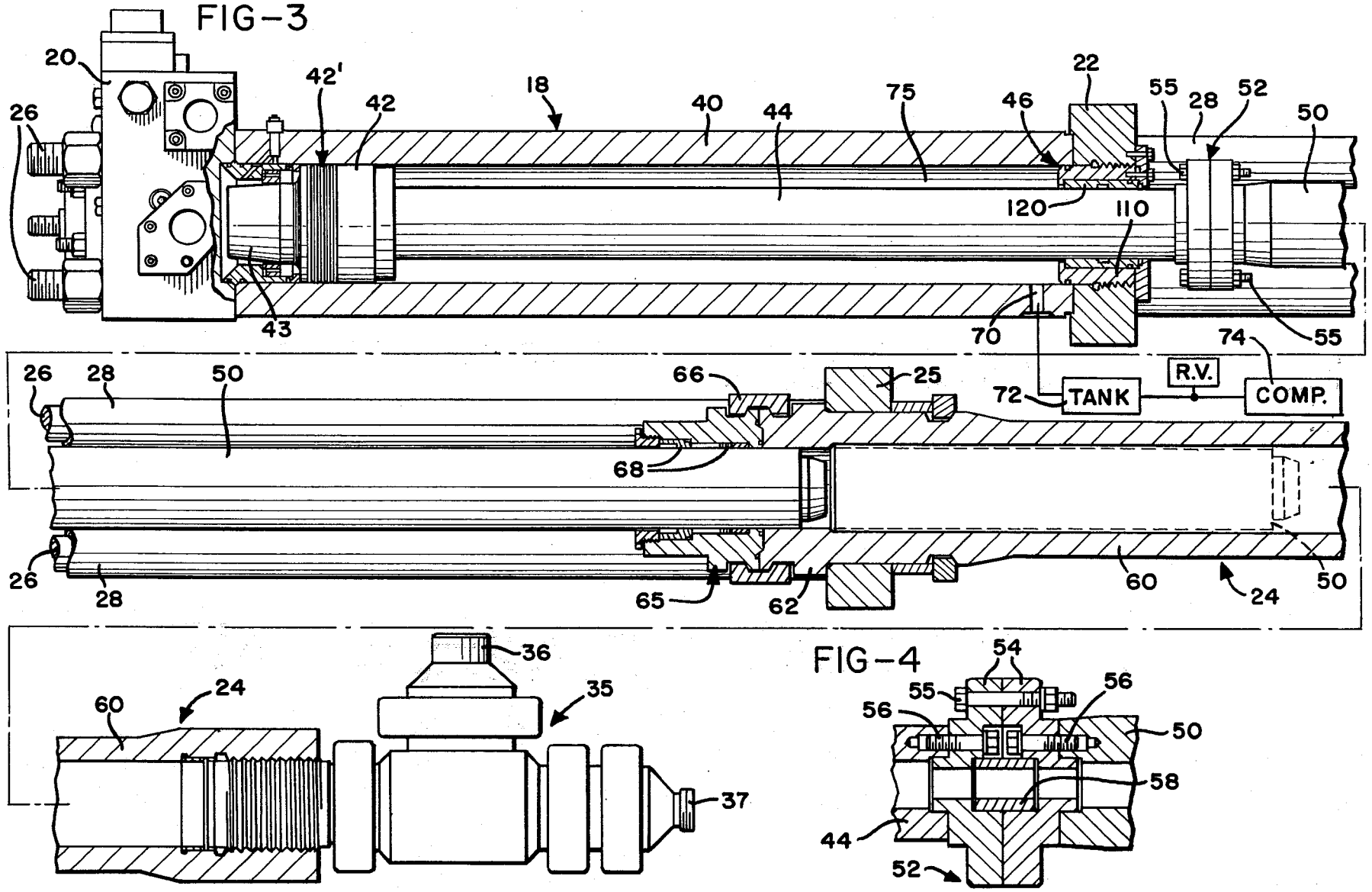
FIG. 3 is a composite longitudinal section through the hydraulic cylinder and the working cylinder of this invention.
FIG. 4 is a section through the coupling which connects the piston rod to the working ram.

Reference may be had to the composite section of FIG. 3 which is taken longitudinally on a vertical plane through one of the intensifiers. The piston motors 18 each have a barrel or cylinder 40 butted directly against the valve manifold block 20 while the forward end of the cylinder 40 is in direct abutment with the facing surface of the intermediate wall 22 and is captured and maintained in compression therebetween by reason of the tension on the tie rods 26. The hydraulic piston motor includes a piston 42 with a rear extension portion 43. The piston 42 is grooved to carry a plurality of high pressure fluid seals 42' thereon. Coupled to the piston 42 is an elongated, forwardly extending piston rod 44. The forward end of the rod extends through a removable packing and bearing assembly indicated generally at 46 received in the wall 22.

A working ram 50 is removably coupled to the rod 44 by means of a coupling indicated generally at 52 in FIG. 4. The coupling 52 consists of a pair of abutting flange members 54 which are held together by bolts 55, and which are respectively attached to the rod and ram by internal bolts 56. An aligning sleeve 58 is captured between the flange members 54. The connector assembly 52 serves to connect the forward end of the rod 44 with the rear end of the working ram 50 and is located in the clearance space 30 defined between the intermediate wall 22 and the front wall 25.

The working ram 50 moves inside of a ram cylinder 60. The working cylinder 60 is carried on the front wall 25 and in fact is assembled from a position behind the wall with a major portion of the cylinder 60 extending axially through the wall. The forward end of the ram cylinder 60 supports the valve assembly 35 while the rearward end thereof is shouldered as indicated at 62 to engage the adjacent inside surface of the front wall 25. A ram packing or sealing assembly 65 is removably attached to the rear end of the cylinder 60 by means of a split clamp 66. The packing assembly 65 contains high pressure packings 68 which are in engagement with the outer surface of the ram 50.

The ratio of areas between the piston 42 and the ram 50 determine the ratio of intensification applied to the fluid being pumped by the ram portions 15 of this invention. For example, the piston 42 may have a diameter of 11 inches and while the effective diameter of the ram 50 may be in the order of 6 and ¼ inches so that 7000 PSI hydraulic pressure applied to the pistons 42 results in the application of 21,000 PSI pressure available at the working rams.

The invention employs a control system by means of which the movement of the individual intensifier rams is controlled so that a smooth, pulseless output is provided; and for this purpose, the control system which is disclosed and claimed in U.S. Pat. No. 3,773,438 may be used. However, the intensifiers of the present invention employ an improved piston return arrangement including an inlet 70 through which compressed air under regulated pressure from a tank 72 and compressor 74 may be applied to the annular interior region 75 surrounding the rod 44 ahead of the piston 42. Also, in some installations, the working fluid itself may be applied under a positive head through the inlet 36 of the valve assembly 35 thus assisting in the return of the intensifier piston to its starting position, it being important that the rams and associated hydraulic pistons move to their starting position for pre-pressurization prior to the compression of the working structure of the other intensifier.

Means for cushioning the return movement includes a return valve mechanism which is illustrated generally at 80 in FIG. 10. The mechanism 80 includes an annular housing 82 received against the block 20 within the inner end of the cylinder 40. The housing 82 is formed with an annular outer groove 83. The housing 82 also receives an annular slide valve member 84 which is formed with a plurality of acurately spaced, axial passages 85. When a hydraulic pressure is applied through the manifold block 20, the member 84 moves to the right as shown in FIG. 10 and is captured there by a retainer 88, and hydraulic fluid under pressure is applied through the relatively large passages 85 directly to the piston 42. The piston extension 43 includes a cylindrical portion 43A and terminates in a tapered portion 43B. Upon return movement, the hydraulic fluid flows freely through the large central opening in the valve mechanism 80 and then through the space of diminishing dimension which surrounds the tapered end 43B. When the tapered end first enters the region of the sliding valve member 84, the force of the returning fluid causes this valve member to return to the left-hand position against the housing 82, as shown in FIG. 10, while fluid continues to escape past the space surrounding the tapered portion 43B. Once the tapered portion 43B has been passed, the intermediate cylindrical portion 43A enters the region of the sliding valve member 84 and thereafter, the major portion of the return flow is distributed through short radial passages 89 and into the annular groove 83, where the rate of fluid flow is controlled by an adjustable valve 90 for return through the passageways 92 and 93 to the block 20. Thus, the piston assembly including the connecting rod and the attached ram 50 is decelerated to a stop by reason of the operation of this hydraulic cushioning mechanism.

As previously noted, the portion of this apparatus which is necessarily subjected to the greatest rate of wear includes the ram packings 68 as well as the ram itself and the ram cylinder 60. It thus may be necessary to replace the packings or even replace the ram or its associated cylinder due to wear and the present invention provides means by which these parts may readily be removed and disassembled in the field without the necessity of disturbing the tie bolts 26 or the supporting walls 22 or 25. The intermediate wall 22 and the front wall 25 define an open clearance space 30 between the adjacent upper pair of tie rods 26 which has an axial length and width somewhat greater than the length and width of either of the rams 50, the ram cylinder 60, or the assembled piston 42 and rod 44. Thus, this space provides the means by which these vital components may be disassembled and assembled for field replacement or service as required, substantially in the manner illustrated in the sequential FIGS. 5–9.

Figure 5:
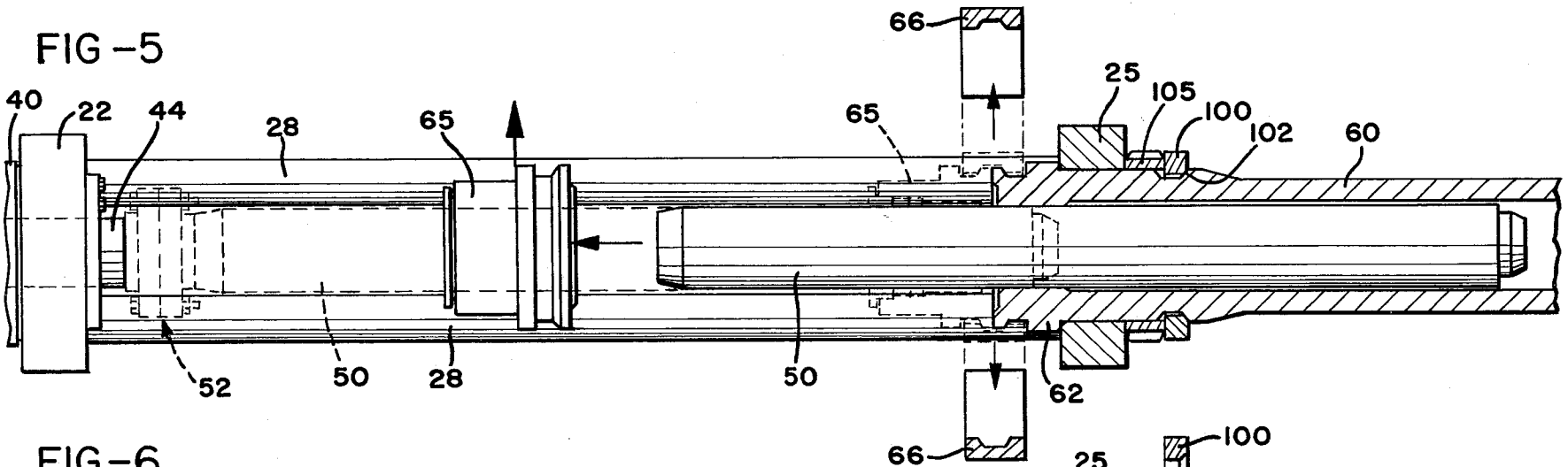
FIG. 5 is a diagram of the portion of the intensifier which is forward of the intermediate wall showing the first steps in the removal of the working ram.

In the event that the packing 68 fails, the split clamp 66 is removed as illustrated in FIG. 5 thus permitting the packing assembly 65 to be moved rearwardly along the ram 50. The coupling member or connector assembly 52 is now opened by the removal of the bolts 55 thus permitting the packing assembly 65 to be removed from the rear end of the ram 50 and upward between the adjacent tie rods.

Figure 6:
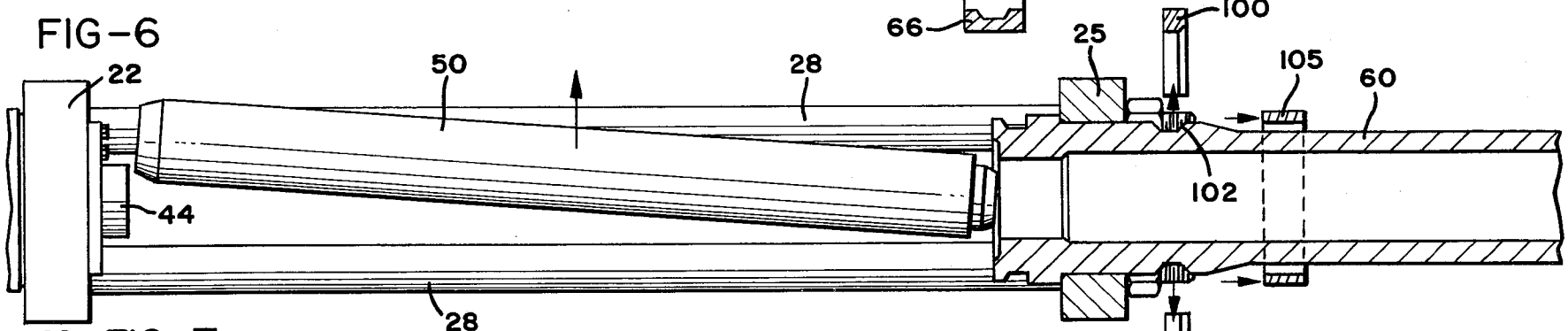
FIG. 6 is a view similar to FIG. 5 showing the manner in which the working ram is removed and the initial steps in removing the ram cylinder.
Figure 7:
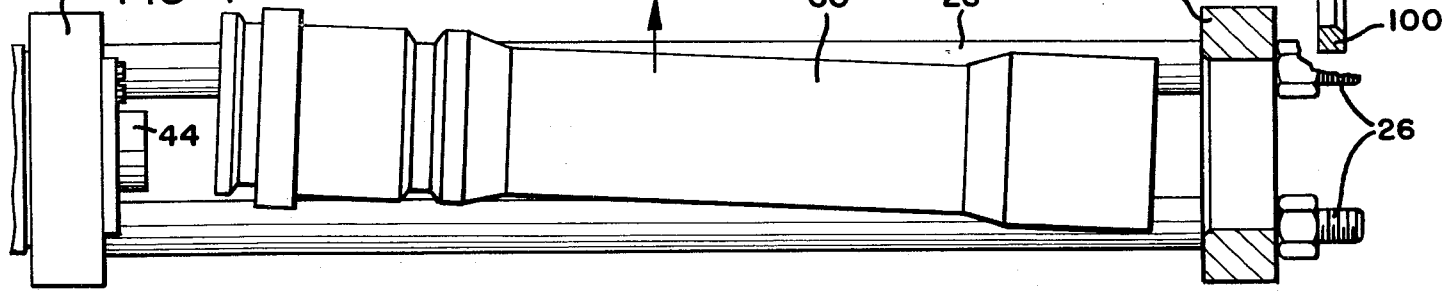
FIG. 7 is a view similar to FIG. 6 showing the manner in which the ram cylinder is removed.

In the event that it is desired to remove the ram 50 itself, for inspection or maintenance, the piston rod 44 is retracted by hand or by application of air pressure through the inlet 70 in the position shown in FIG. 6 and with the assembly 65 disconnected, the ram 50 may then be removed by lifting through the clearance space 30. Further in the event that it is necessary to remove the ram cylinder for inspection, the valve assembly 35 at the front is first removed and then a split clamp 100 which engages a tapered shoulder 102 on the outer surface of the cylinder is removed. The clamp 100 and shoulder 102 cooperate with a sleeve 105 to bear against the front surface of the front wall 25 and with the clamp 100 removed, the sleeve 105 may be axially extracted as shown in FIG. 6 and then the working cylinder 60 itself may be retracted into the clearance space 30 and withdrawn as shown in FIG. 7. It is important to note that none of this disassembly has required a loosening or removal of the pretension on the tie rods 26, nor a breaking of any hydraulic connections.

In some instances it may be necessary to inspect or replace this packing 42' on the piston 42. To accomplish this, the removable packing and bearing assembly 46 is first extracted. The assembly includes an outer sleeve 110 formed with outer acme threads 111 which engage cooperating internal threads formed in the intermediate wall. An annular nut member 115 is secured to the front surface of the sleeve 110 by bolts 116 and a suitable wrench may be attached to rotate the sleeve 110 on its threads.

FIG. 8 shows the packing assembly in a partially removed condition in full lines while the seated position is shown in broken lines. A sleeve bearing and packing member 120 is captured between the nut member 115 and the threaded sleeve 110 and is thus extracted off the end of the piston rod 44. Single pneumatic packing may be carried by the bearing member 120 since only return air pressure, which may be in the order of 150 PSI, is applied through the space 75, and even the small leakage can be tolerated.

With the bearing assembly 65 removed, the front end of the rod 44 is now free, and a clearance space is provided through the intermediate wall 22 which has a diameter at least as large as the inside diameter of the cylinder 40, thus permitting the assembled rod piston to be removed through the clearance space 30 substantially as shown in FIG. 9. Since the packings are carried directly on the piston, they are now fully exposed for inspection and maintenance as required.

In summary, the arrangement of the intensifier apparatus of this invention is one in which field maintenance may be more readily performed than that of the intensifier structure shown in the prior U.S. Pat. No. 3,773,438. The packing assembly 65 is formed as a part separate from the ram cylinder 60 so that the packing assembly can be removed and repaired or replaced merely be removing the split clamps 66 and opening the connector assembly 52 which connects the piston rod 44 with the ram 50. Since the ram and ram cylinder themselves are subject to wear due to the abrasive or corrosive nature of the material being handled, these parts may also be removed leaving undisturbed the pre-tensioning of the tie rods 26.

The forward removable bearing and packing assembly 46 associated with the hydraulic piston motors may also be readily serviced by applying a rotational force to the nut 115 thus extracting the outer sleeve 110 and the bearing member 120. This assembly is then removable by opening the connector assembly 52 and removing one of the flanges 54 to permit the bearing assembly 46 to be slipped off the end of the piston rod 44.

The invention further includes an improvement in the ram return arrangement over that of the prior patent identified above. In that patent separate ram return cylinders were employed whereas in the present invention, air under regulated pressure is applied through the inlet 70 into the annular space 75 surrounding the rod 44 at all times and this serves for quickly returning the intensifier assembly to the resting or starting position as shown in FIG. 3. The adjustable hydraulic cushioning mechanism shown in FIG. 10 assures that the mass of the intensifier ram and pistons is decelerated at a controlled rate to prevent vibration and to eliminate the force of impact by reason of these parts returning to their starting or resting position, for pre-pressurization, to provide an essentially pulseless output at the valve assembly 35.

While the forms of apparatus herein described constitute preferred embodiments of the invention, it is to be understood that the invention is not limited to these precise forms of apparatus, and that changes may be made therein without departing from the scope of the invention.

What is claimed is:

1. An improved hydraulic intensifier for oil well fracturing, erosion drilling or the like having a bed and at least two intensifier units mounted on said bed in which the intensifier units each include a hydraulic piston motor connected in direct driving relation to a working ram, the improvement in intensifier structure providing for ease of maintenance in the field comprising means defining a back wall, an intermediate wall spaced from said back wall and a front wall spaced from said intermediate wall, the cylinder of said hydraulic piston motor positioned between said back wall and said intermediate wall, the working ram including a ram cylinder supported in an opening formed on said front wall, said front wall, intermediate wall and back wall being joined by a plurality of tension rods, spacer sleeves on said rods between said intermediate wall and front wall and defining therebetween a generally open clearance space, a piston rod assembly in said cylinder having a forward end extending into said space, a working ram received in said ram cylinder and having a rear end received in said space, removable coupling means in said space joining said rod and ram, the axial length and transverse width of said clearance space being greater than the corresponding length and width of either said ram or ram cylinder, said ram and said ram cylinder being removable through said space without disturbing said tension rods.

2. The hydraulic intensifier of claim 1 further comprising support means positioned between said bed and the forward ends of said rams, said support means, said front walls, said intermediate walls, and said back wall being mounted on said platform by means of elastomeric blocks fitted therebetween providing for slight aligning movement between said intensifier ram and said piston motor during operation.

3. The intensifier of claim 1 in which said ram cylinder is formed with a radial shoulder adjacent its inner end proportional to engage the inside surface of said front wall with a major portion of said ram cylinder extending forwardly of said front wall, and split clamp means engaging said ram cylinder forwardly of said front wall for retaining said ram cylinder therein.

4. The intensifier of claim 3 further comprising a ram packing assembly removably mounted on said ram cylinder inwardly of said front wall and forming an effective inward extension of said ram cylinder.

5. The intensifier of claim 1 in which said piston rod assembly includes a piston and an attached forwardly extending rod, and bearing means removably received in said intermediate wall having an outer diameter at least as great as that of said piston providing for withdrawal of said piston assembly through said intermediate wall and into said clearance space.

* * * * *